US005558796A

United States Patent [19]

Cho

[11] Patent Number: 5,558,796

[45] Date of Patent: Sep. 24, 1996

[54] APPARATUS FOR ADJUSTING THE COOKING TIME AND POWER OUTPUT OF A MICROWAVE OVEN

[75] Inventor: Whan H. Cho, Suwon, Rep. of Korea

[73] Assignee: Samsung Electronics Co., Ltd., Suwon, Rep. of Korea

[21] Appl. No.: 420,099

[22] Filed: Apr. 11, 1995

[30] Foreign Application Priority Data

Apr. 11, 1994 [KR] Rep. of Korea ..... 1994-7543

[51] Int. Cl.[6] ..... H05B 6/68

[52] U.S. Cl. ..... 219/702; 219/715; 219/721; 200/5 A; 200/5 B; 200/14

[58] Field of Search ..... 219/715, 702, 219/719, 721; 200/11 R, 14, 117 W, 5 A, 5 B, 38 A, 38 FA, 336

[56] References Cited

U.S. PATENT DOCUMENTS

| | | | |
|---|---|---|---|
| 3,564,310 | 2/1971 | Willis | 200/38 |
| 3,621,158 | 11/1971 | Swinstead | 200/14 |
| 4,600,826 | 7/1986 | Ishimura | 219/719 |
| 5,134,262 | 7/1992 | Lee | 219/719 |
| 5,349,164 | 9/1994 | Ohta | 219/715 |

*Primary Examiner*—Philip H. Leung
*Attorney, Agent, or Firm*—Burns, Doane, Swecker & Mathis, L.L.P.

[57] ABSTRACT

A microwave oven has a cooking time selecting unit and a cooking power selecting unit. The cooking time selecting unit has a first shaft which extends through a control panel and a first knob is mounted on the first shaft. The cooking power selecting unit has a second shaft which is disposed parallel to the first shaft and extends through the control panel. A second knob is mounted on the first shaft and has an outwardly open recess in which the first knob is freely rotatably disposed. A rotary power transmitter such as an idler gear or a timing belt interconnects the second knob and second shaft.

6 Claims, 5 Drawing Sheets

APPARATUS FOR ADJUSTING THE COOKING TIME AND POWER OUTPUT OF A MICROWAVE OVEN

BACKGROUND OF THE INVENTION

This invention relates to device for adjusting the power output of a microwave oven, and more particularly, a device for adjusting the power output of a microwave oven which has two knobs for operating the time control unit and a power output control member, respectively.

A typical microwave oven, shown in FIG. 4, comprises a body 40, and a door 50 hingedly attached at one vertical side of the body 40 for opening/closing a front opening of a heating compartment 80. At the front surface of the body 40 a control panel portion 60 is disposed beside the door 50. On the control panel portion 60 a control device 70 is provided for adjusting the output of power.

The control device 70, shown in FIG. 5, comprises an operating time control member 71 for controlling cooking time and an output control member 72 for controlling the magnitude of magnetron (not shown) output at various step levels. Both control members 71,72 are attached to a bracket 74 in a vertically spaced manner. A first rotating shaft 75 protrudes from the operating time control member 71 and extends through an opening 61 of the control panel portion 60, while a second rotating shaft 76 protrudes from output control member 72. At respective free ends of rotating shafts 75,76 respective knobs 77,78 are mounted for convenience of manual control. Since the size of the gripping portion of respective knobs 77,78 is adapted to the fingers of a user, the distance between the rotating shafts 75,76 is inevitably relatively far. That causes the length of the bracket 74 supporting both rotating shafts 75,76 to be relatively long.

In a microwave oven having a conventional control device 70, foods are placed in the heating compartment 80 first. Depending on the characteristics of food items, the output level and the operating time are selected. The knob 78 for the second rotating shaft 76 is rotably set to point to the appropriate power level, and next, the knob 77 for the first rotating shaft 75 is set to indicate the selected time range, also.

But, since knobs 77,78 are located at the different positions, i.e. knobs directly connected to respective rotating shafts 75,76 are distanced from each other, the working line of the user's hand is required to move some distance, which causes inconvenience for the user. Further, the lengthy bracket caused by the distanced knobs reduces the compactness of the control device 70. Furthermore, the multiple knobs positions take away from the appearance of the control panel portion 60.

SUMMARY OF THE INVENTION

It is, accordingly, an object of this invention to provide a device capable of adjusting the magnitude of power and the cooking time at the same position on the control panel, in which the rotating centers of respective adjusting means are coaxially arranged.

It is a further object of this invention to provide a device for adjusting the cooking time and power output in a microwave oven capable of achieving a compactness of the control device to reduce the size of the bracket of the control device.

It is a further object to provide a device for adjusting the cooking time and power output in a microwave oven capable of improving the appearance of the control panel portion.

In accordance with the present invention, the device for adjusting the power output in a microwave oven comprises a first operating means connected coaxially with a rotating shaft of first adjusting portion, and a second operating means for operating a rotating shaft of a second adjusting portion disposed parallelly to the rotating shaft of first adjusting portion in a determined distance. Further, the second operating means is disposed rotatably within the first operating means, a rotating center of the second operating means provided coaxially with the rotating shaft of first adjusting portion.

DETAILED DESCRIPTION OF THE PREFERRED EMBODIMENTS

Figure 1:
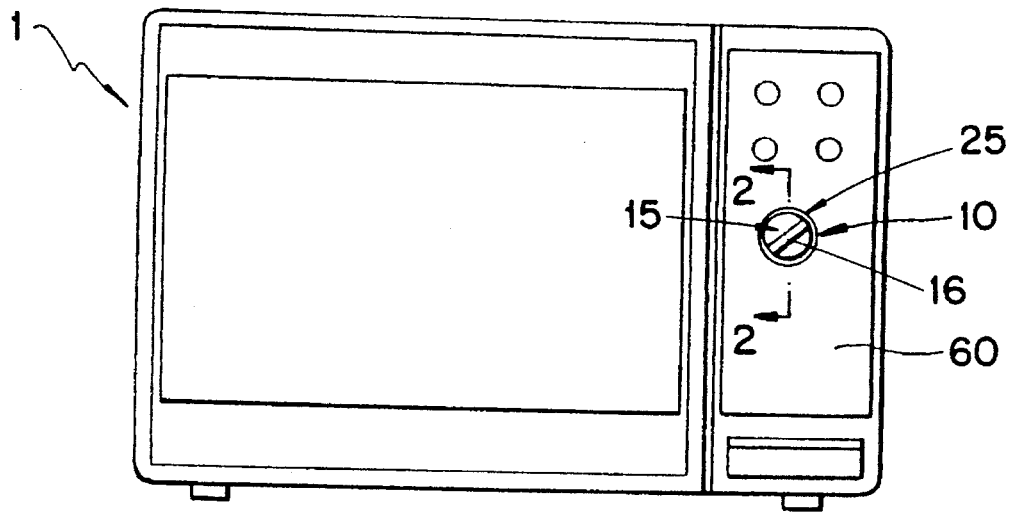
FIG. 1 is a front view of a microwave oven according to the present invention.

FIG. 1 illustrates the front view of the microwave oven according to the present invention, in which a control device 10 is disposed at a control panel portion 60 provided at the front surface of a body 1. The control device 10, shown in FIGS. 2 and 3, comprises an operating time control member 11 and a power output control member 21 which are attached at the rear surface of a bracket 29. A first rotating shaft 13 protrudes from the operating time control member 11 through an opening 61 of the control panel portion 60 and extends for a prescribed length, while a second rotating shaft 23 protrudes from power output control member 21 until the free end of the second rotating shaft 23 extends adjacent to the rear surface of the control panel portion 60.

At the free end of the first rotating shaft 13 a first knob 15 is press-fitted coaxially onto the knob 15. On the front surface of the first knob 15 a gripping portion 16 in the shape of "I" is provided to facilitate rotation. Behind the first knob 15, a second knob 25 in the form of an outwardly open hollow cylinder is placed to receive the first knob 15. The knobs 15,25 do not interfere with the rotation of each other. At a central portion of a recess of the second knob 25 an opening 26 is provided for extending the first rotating shaft 13 therethrough. At the upper and lower periphery of the opening 26, a couple of protuberances 27 in the shape of "I" are provided, respectively, for entering grooves 32 of a driving member 30 described later (see FIG. 3). Around the circumferential surface of the second knob 25, a serration structure is provided to avoid slip.

Figure 3:
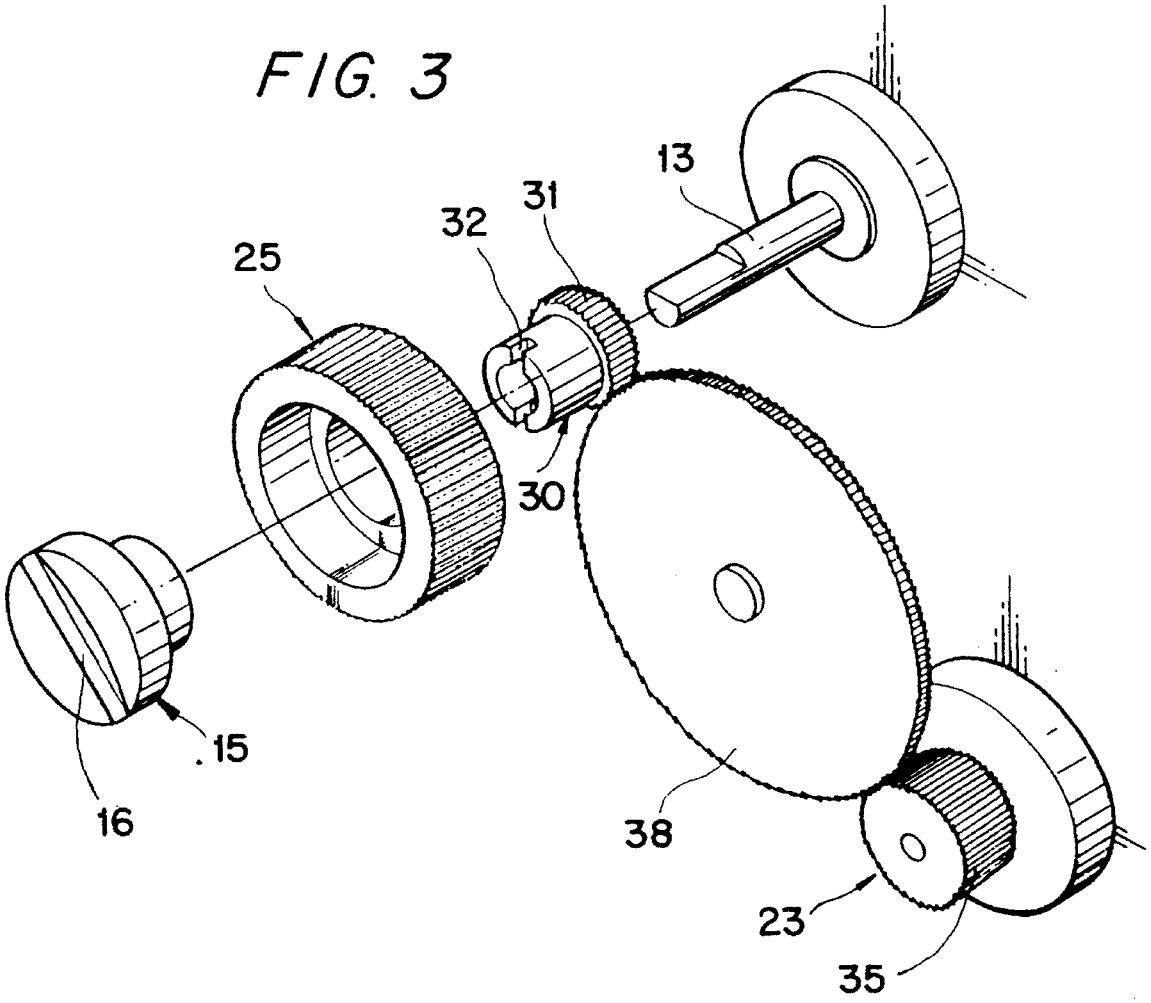
FIG. 3 is an exploded perspective view of FIG. 2.
Figure 3A:
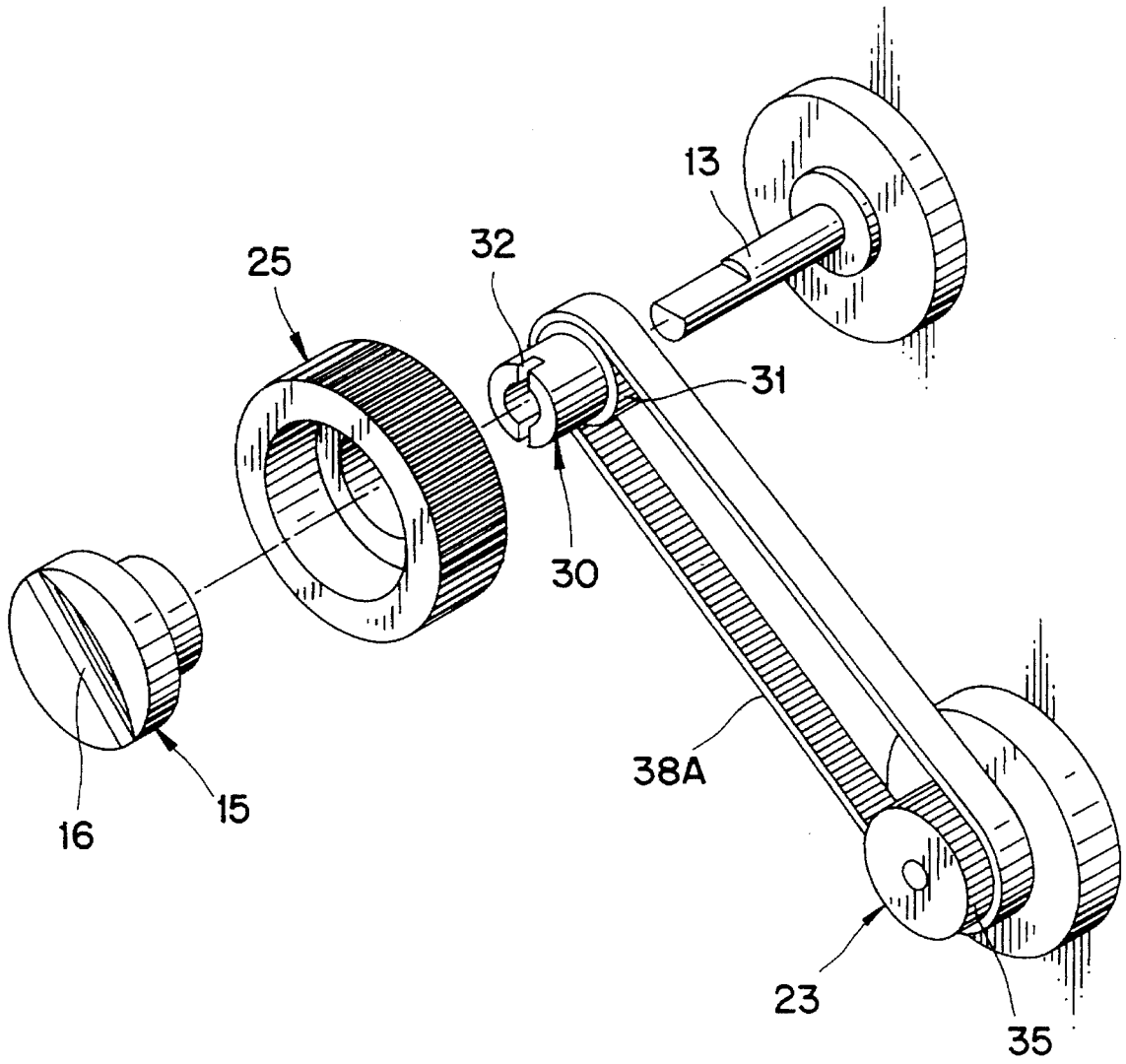
FIG. 3A is a view similar to FIG. 3 of an alternate embodiment of the invention.
Figure 4:
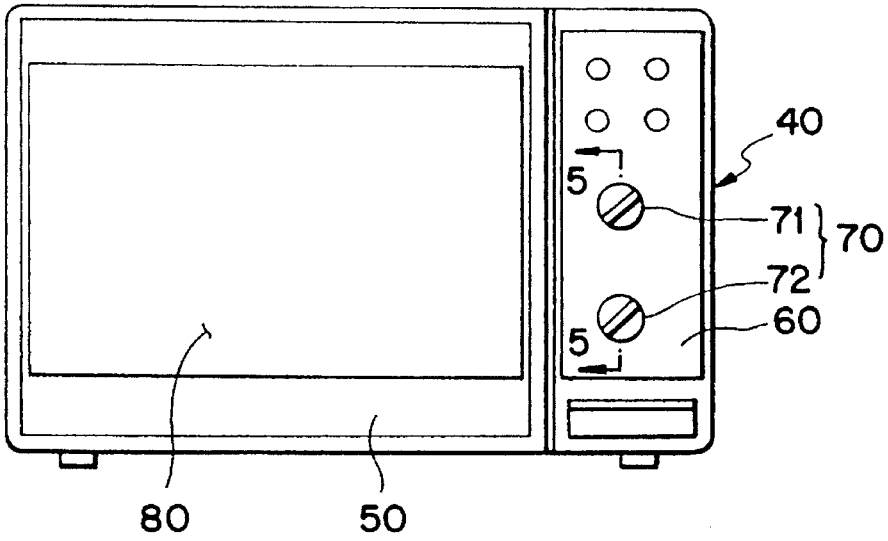
FIG. 4 (PRIOR ART)
FIG. 4 is a front view of the microwave oven according to a prior art.
Figure 5:
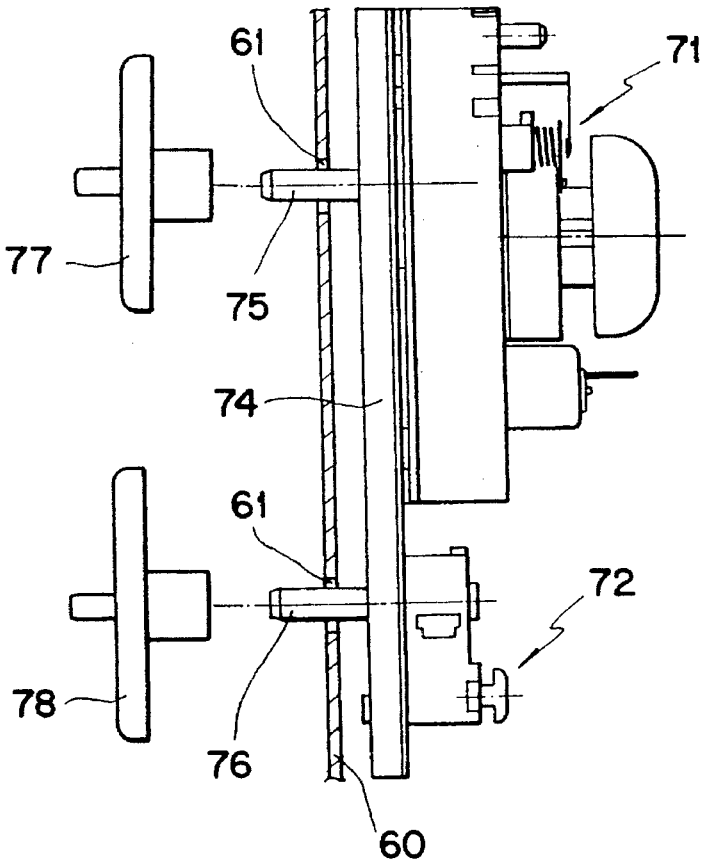
FIG. 5 (PRIOR ART)
FIG. 5 is a partial sectional view of the device for adjusting the cooking time and power output taken along line 5—5 of FIG. 4.
Figure 6:
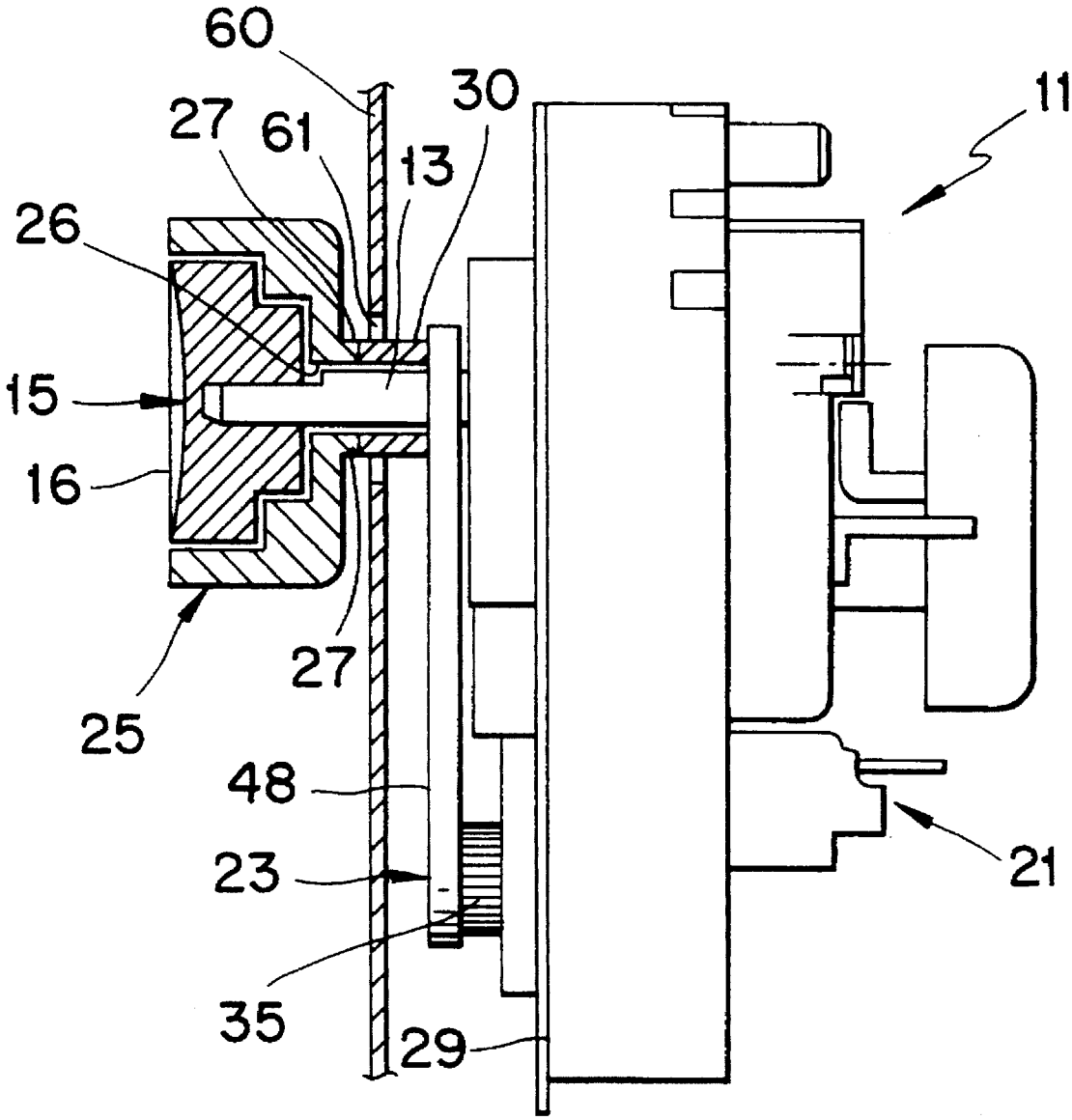
FIG. 6 is a view similar to FIG. 2 of an alternate mechanism for adjusting the power output.

The cylindrical driving member 30 is free-rotatably installed coaxially on the first rotating shaft 13. At the front end of the driving member 30, a couple of grooves 32 are provided for receiving the protuberances 27 of the second knob 25. Spur gear teeth 31 are formed on the circumferential surface of a flange provided at the rear end of the driving member 30. Also, on the circumferential surface of the second rotating shaft 23 a driven gear 35 in the form of a spur gear is formed. Between the spur gear 31 and the driven gear 35, an idler gear 38 is engagingly disposed to transmit the rotation of the spur gear 31 to the driven gear 35. Alternatively, a positive drive belt or timing belt 48 which has teeth molded on the internal surface of the belt 38A (see FIG. 3A) mating the teeth of respective gears 31,35 may be employed in lieu of the idle gear 38 as shown in FIG. 6.

The device for adjusting the power output of a microwave oven, having the construction as described above, is operated as follows.

Figure 2:
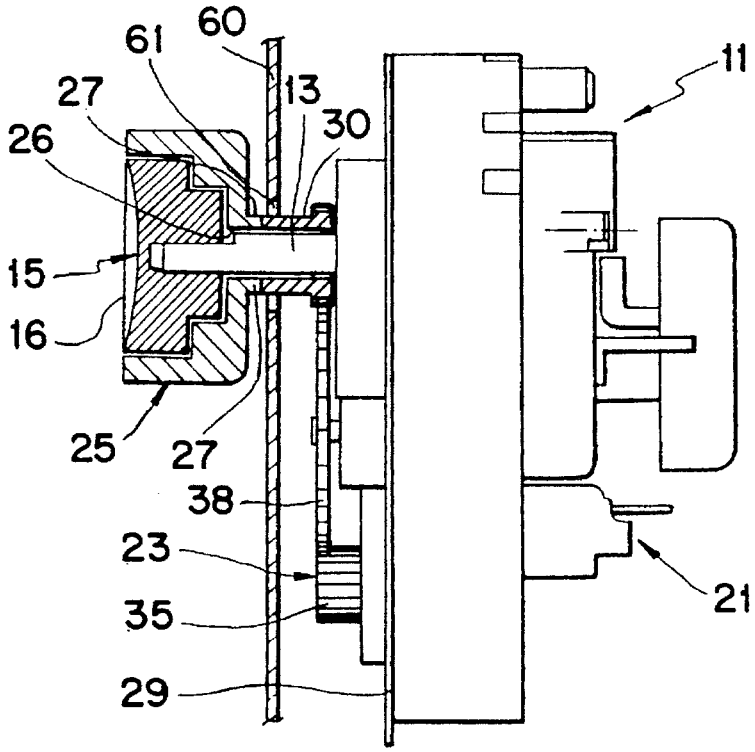
FIG. 2 is a partial sectional view of the device for adjusting the cooking time and power output taken along line 2—2 of FIG. 1.

First, foods are displaced in the heating compartment of the body 1. The second knob 25 is rotatably set to the appropriated level indicated on the control panel portion 60. Simultaneously, the driving member 30 engaged to the second knob 25 rotates, and the rotation of the driving member 30 is transmitted to the second rotating shaft 23 by the rotation of the idler gear 38. The power level selection is accomplished by the appropriate turning of the second rotating shaft 23 (FIG. 2).

Since the first knob 15 is coaxial with the second knob 25, the user's fingers grasp the portion 16 of the first knob 15 without moving an appreciable distance. The first knob 15 housed in the second knob 25 is freely rotated until the first rotating shaft 13 reaches an appropriate cooking time. Thus, the cooking time control process is also accomplished.

As described above, the device according to the invention allows user to conveniently control, at the same place on the control panel, the adjustment of time as well as the level of output-power. Further, owing to the combining knobs in a coaxial line, the size of the bracket for attaching control members is significantly reduced. Furthermore, owing to a single set of knobs on the control panel portion the appearance of the microwave oven is improved.

What is claimed:

1. Apparatus for adjusting the operating functions of a microwave oven comprising:

a first function control unit for controlling a first operating function and having a first rotary shaft;

a second function control unit for controlling a second operating function and having a second rotary shaft spaced from and arranged parallel to said first shaft;

a first manual rotary actuator operably connected to said first shaft for rotating said first shaft in response to rotation of said first manual rotary actuator; and a second manual rotary actuator operably connected to said second shaft for rotating said second shaft in response to rotation of said second manual rotary actuator;

said first and second manual rotary actuators being rotatable about a common axis;

wherein said second manual rotary actuator is operably connected to said second shaft by an idler gear lying in a plane oriented perpendicularly to said common axis, said idler gear mounted for rotation about an axis disposed between and parallel to said first and second shafts, said idler gear being operably connected to gear teeth rotatable with said second manual rotary actuator and to gear teeth rotatable with said second shaft.

2. The apparatus according to claim 1 further including a control panel, said first and second function control units and said idler gear disposed to the inside of said control panel; said first and second manual rotary actuators disposed to the outside of said control panel; and said first and second shafts extending through said control panel.

3. The apparatus according to claim 1 wherein said first manual rotary actuator comprises a first knob fixedly mounted on an end of said first shaft, said second manual rotary actuator comprising a second knob freely rotatably mounted on said end of said first shaft, said second knob having an outwardly open recess in which said first knob is rotatably disposed, said first shaft extending through said second knob.

4. The apparatus according to claim 1 wherein one of said function control units comprises a cooking time selector, and the other of said function control units comprises a cooking power selector.

5. The apparatus according to claim 4 wherein said first function control unit is said cooking time selector, and said second function control unit is said cooking power selector.

6. Apparatus for adjusting the operating functions of a microwave oven comprising:

a first function control unit for controlling a first operating function and having a first rotary shaft;

a second function control unit for controlling a second operating function and having a second rotary shaft spaced from and arranged parallel to said first shaft;

a first manual rotary actuator operably connected to said first shaft for rotating said first shaft in response to rotation of said first manual rotary actuator; and a second manual rotary actuator operably connected to said second shaft for rotating said second shaft in response to rotation of said second manual rotary actuator;

said first and second manual rotary actuators being rotatable about a common axis;

wherein said second manual rotary actuator is operably connected to said second shaft by an endless belt lying in a plane oriented perpendicular to said common axis, said belt having teeth formed thereon and being operably connected to gear teeth rotatable with said second manual rotary actuator and to gear teeth rotatable with said second shaft.

* * * * *